United States Patent [19]

Armstrong

[11] Patent Number: 4,747,213

[45] Date of Patent: May 31, 1988

[54] TOOL SUPPORT

[76] Inventor: Leonard J. Armstrong, 27 Clove Lakes Pl., Staten Island, N.Y. 10310

[21] Appl. No.: 839,924

[22] Filed: Mar. 17, 1986

[51] Int. Cl.[4] ..... F41G 1/38

[52] U.S. Cl. ..... 30/296 R; 30/231

[58] Field of Search ..... 30/231, 296 R, 296 A; 83/605, 606; 248/163.1, 59, 62; D25/67; 269/139, 188, 250

[56] References Cited

U.S. PATENT DOCUMENTS

| | | | |
|---|---|---|---|
| 176,246 | 4/1876 | Schofield | 83/605 |
| 216,915 | 6/1879 | Unkrich . | |
| 367,846 | 8/1887 | Riber | 83/606 |
| 413,521 | 10/1889 | Kelsey | 30/231 |
| 523,984 | 8/1894 | Hayden | 83/605 |
| 804,426 | 11/1905 | Mullen . | |
| 919,977 | 4/1909 | Szekfu . | |
| 1,001,979 | 8/1911 | Parker | 30/231 |
| 1,078,817 | 11/1913 | Austin . | |
| 2,003,159 | 5/1935 | Taylor | 248/62 |
| 2,632,617 | 3/1953 | Evans | 30/231 X |
| 3,854,205 | 12/1974 | Boskus . | |
| 4,249,308 | 2/1981 | Boyajian . | |

*Primary Examiner*—E. R. Kazenske
*Assistant Examiner*—Michael D. Folkerts
*Attorney, Agent, or Firm*—Fitzpatrick, Cella, Harper & Scinto

[57] ABSTRACT

A tool support inclues clamping members for holding the handle of a conventional tool and leg members for urging the clamping members together to secure the tool handle between the clamping members and for supporting the tool at the desired height. In one embodiment, the clamping members are two identical members with arcuate central portions having flanges, wherein the leg members are rods that extend through holes in the flanges and have threaded ends for accepting nuts to urge the clamping members together with the tool handle therebetween. In an alternate embodiment, one of the clamping members is modified, each leg member has a L-shaped end, and the clamping members and L-shaped ends of the leg members cooperate to prevent the clamping members and legs from twisting.

4 Claims, 2 Drawing Sheets

TOOL SUPPORT

BACKGROUND OF THE INVENTION

1. Field of the Invention

The present invention relates to a tool support and, more particularly, to a tool support useful with conventional tools.

2. Description of the Prior Art

Two-handed tools can be very inconvenient when used for certain jobs. For example, using cutting shears for cutting tree branches into sizes that fit into a trash can for disposal requires first that two hands be used to manipulate the shears and then the cut branches must be picked up and put into the can.

With such two-handed tools, it is very difficult to manipulate the tool and the work at the same time. A conventional approach to overcoming this inherent shortcoming of two-handed tools has been to clamp the work in a vise or similar contrivance so that the tool can be manipulated relative to the work, although this approach clearly will not relieve the necessity of picking up cut tree branches after they have been trimmed for example, by shears, into more convenient lengths. While it is not unknown instead to hold one handle of a two-handled tool, thus freeing one hand for manipulating the work, known devices taking this approach, such as the device shown in U.S. Pat. No. 3,854,205, use specially made tools and are not designed for universal use with conventional two-handed tools.

SUMMARY OF THE INVENTION

It is an object of the present invention to overcome the drawbacks of prior art tool supports.

According to an aspect of the invention, a tool support comprises a clamping device for securely holding the handle of a conventional tool and a leg adapted to be attached to the clamping device for supporting the tool on a surface.

According to another aspect of the invention, such a tool support includes an anti-twist structure for rigidly securing the clamping device and leg together to prevent relative rotation therebetween.

The above and other objects, advantages and aspects of the invention will be understood and more fully appreciated when the detailed description of the preferred embodiment set out below is read in connection with the drawings, briefly described as follows.

DETAILED DESCRIPTION OF THE PREFERRED EMBODIMENTS

Figure 1:
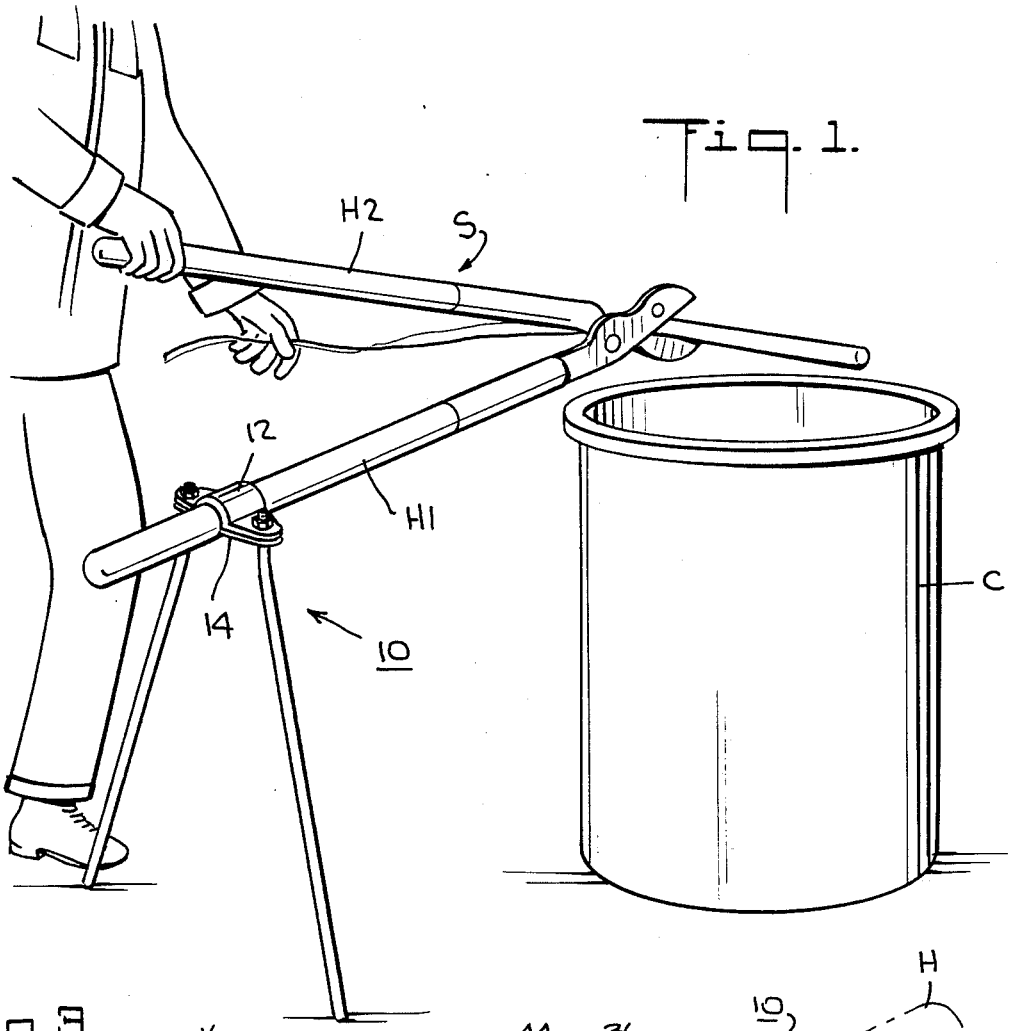
FIG. 1 is a perspective view of one embodiment of the present invention in use.
Figure 3:
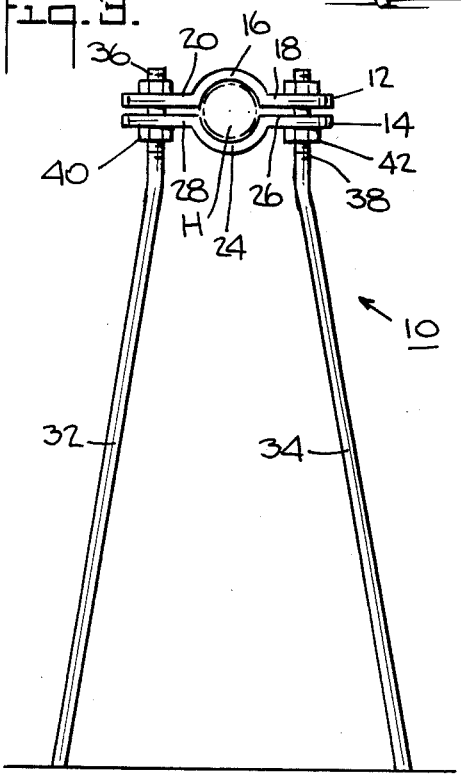
FIG. 3 is a perspective view of a portion of the embodiment shown in FIGS. 1 and 2.
Figure 2:
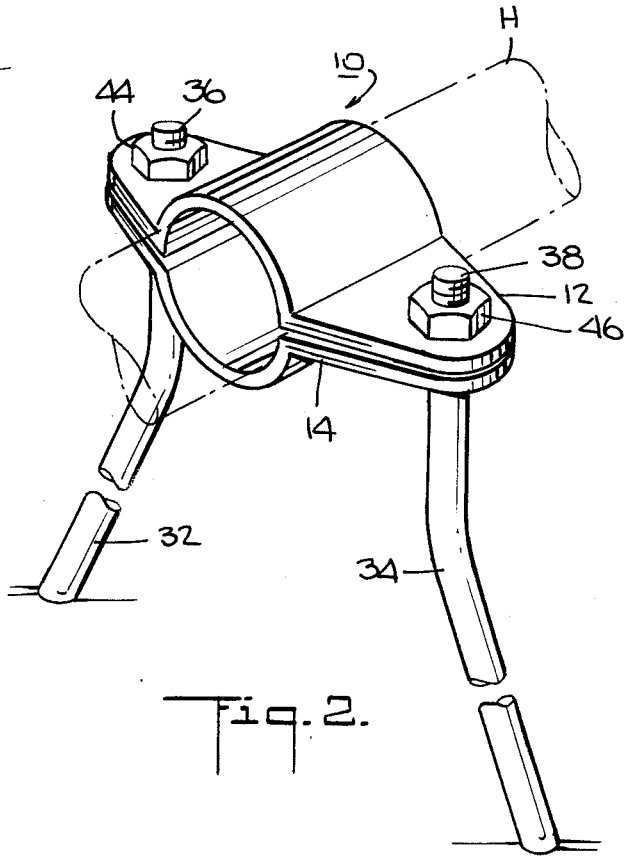
FIG. 2 is a front view of the embodiment shown in FIG. 1.

FIGS. 1 through 3 illustrate a first embodiment of a tool support 10 in accordance with the present invention.

This tool support includes a clamping device having a first clamping member 12 and a second clamping member 14. The first clamping member 12 is a plate that has an arcuate, central portion 16, which may be generally circular in cross-section, spanning a pair of generally diametrically opposed flanges 18 and 20. Each flange 18 and 20 has a hole through it that is generally centrally located in it. The second clamping member 14 is substantially identical to the first clamping member and also includes an arcuate central portion 24 and a pair of flanges 26 and 28, each having a hole through it that is generally centrally located in it.

The tool support 10 also comprises a rod as a first leg 32 and an identical rod as a second leg 34. The end 36 of the leg 32 and the end 38 of the leg 34 are threaded. Two nuts 40 and 42 are threaded onto each of the ends 36 and 38 of the legs 32 and 34. Two more nuts 44 and 46 thread onto the ends of the legs 32 and 34, respectively, to capture the flanges 18 and 26 between the nuts 42 and 46 and to capture the flanges 20 and 28 between the nuts 40 and 44. All of the nuts are identical.

In use, a handle H (shown in phantom lines in FIGS. 2 and 3) of a conventional tool is clamped between the clamping members 12 and 14 by the nuts 40, 42, 44 and 46, which thus act as fastening means for urging the cooperating flanges 18, 26 and 20, 28 of the clamping members together to secure the handle H therebetween. By loosening cooperating pairs of nuts 40, 42 and 44, 46, the handle H can be removed from the tool support 10. It will also be appreciated that the extent of the arcuate central portions 16 and 24 is together slightly smaller than the circumference of the handle H, so that the handle H is compressed between the clamping members 12 and 14 when the nuts are tightened. The rods are bent as shown in FIG. 2 so that they are closer together where they are attached to the clamping members than at the ends where they may be rested on the ground.

FIG. 1 illustrates one use of the tool support of the present invention. In this use, a conventional shears S has one handle H1 clamped between the clamping members 12 and 14 proximate to the end of the handle H1. The legs 32 and 34 are approximately as long as the height of a trash can C so that the shears may be supported above the ground at a level which eases manipulation of the work to be operated on, such as a twig to be cut using the shears. A user can grasp twigs or the like with one hand and the free handle H2 of the shears S with the other hand, and thus, in one step, can cut the twigs into a length which readily fits into the trash can C and deposit them into the trash can, while avoiding having to gather the cut pieces. When the tool support 10 is in use, with a tool handle clamped between the clamping member 12 and 14, the distance between the lower portions of the legs provides a very stable base for the tool.

The tool support 10 shown in FIGS. 1 through 3 has numerous advantages. It can be designed to accommodate different conventional tools with handles of different sizes and shapes; it can be completely disassembled for shipping, sale and storage; and it has only three different parts, the clamping members 12 and 14, the legs 32 and 34 and the nuts 40, 42, 44 and 46.

Of course, the tool support of the present invention need not assume the form shown in FIGS. 1 through 3. It can have, for example, more than two legs or fastening means separate from the legs, and still provide the advantages of the present invention over the prior art. In addition, even more versatile operation and convenient storage can be obtained by providing telescoping legs.

In spite of its numerous advantages, however, the embodiment depicted in FIGS. 1 through 3 can permit rotation of the legs 32 and 34 relative to the clamping members 12 and 14, and thus is liable to twist about an axis normal to the ground (that is, about a vertical line in the plane of FIG. 2) when in use, because the only resistance to such motion is the frictional forces between the faces of the nuts and the flanges. The embodiment of the invention depicted in FIGS. 4 and 5 incorporates an anti-twist structure that overcomes this problem. Parts comprising the tool support 10' that are the same as those comprising the tool support 10 shown in FIGS. 1 through 3 are identified by the same reference numerals. Therefore, the first clamping member 12 and the nuts 44 and 46 are the same as in the embodiment previously described.

The second clamping member 114 includes a central arcuate portion 124 spanning a pair of flanges 126 and 128, each of which has a hole centrally located therein. The flange 126 terminates in a depending tab **126*a* and the flange 128 terminates in a like depending tab 128*a*. The depending tab 126*a* has a hole 126*b* therethrough and the depending tab 128*a* has a hole 128*b*** therethrough.

The tool support 10' further comprises a rod as a first leg 132 and an identical rod as a second leg 134. The first leg 132 has an L-shaped offset portion 136, and the second leg 134 has an L-shaped offset portion 138. The L-shaped portions 138 and 136 extend through the holes **126*b* and 128*b*, respectively, and the ends of the portions 136 and 138 extend through the holes in the flanges 20, 128 and 18, 126. The ends of the portions 136 and 142 are threaded for accepting the nuts 44 and 46**.

It will be appreciated that after the handle H (shown in phantom lines in FIGS. 4 and 5) has been passed between the clamping members 12 and 114 when they are loosely held together, the nuts are tightened and the entire assembly is rigid and cannot twist.

Figure 4:
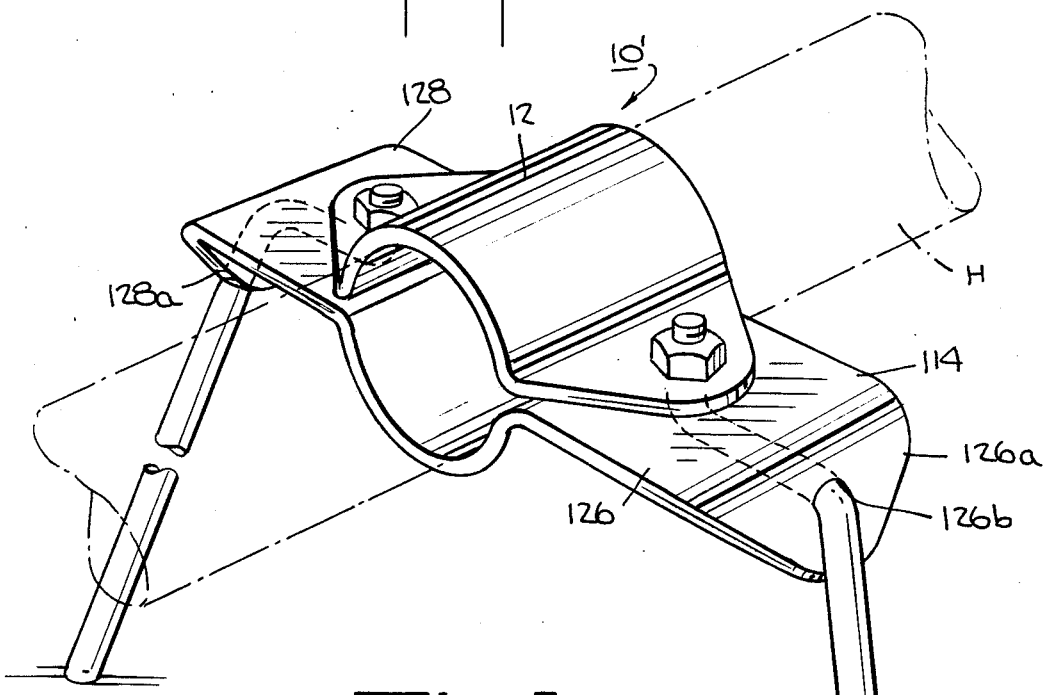
FIG. 4 is a perspective view of a detail of another embodiment of the present invention.
Figure 5:
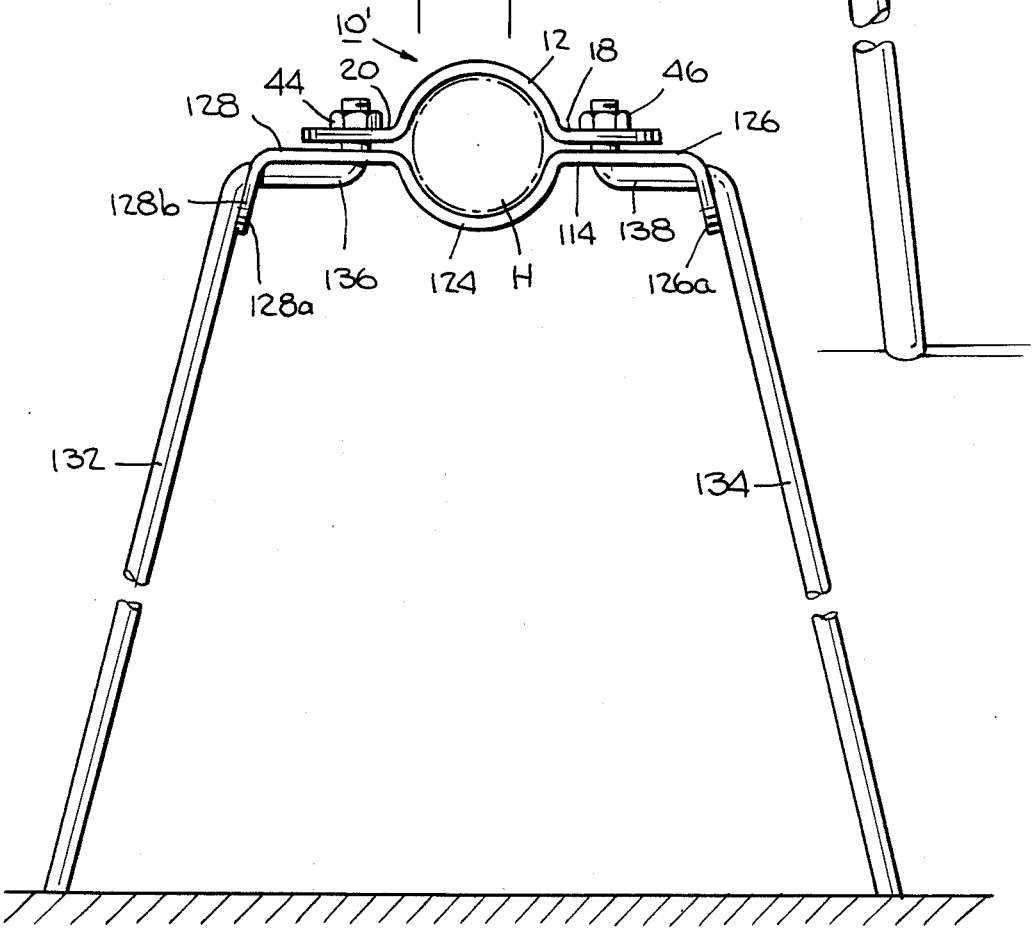
FIG. 5 is a front view of the embodiment shown in FIG. 4.

Of course, while other embodiment of the anti-twist structure may be employed (such as by welding the legs to the clamping member 114), the embodiment shown in FIGS. 4 and 5 has the advantages of using only four different parts (the two clamping members 12 and 114, the legs 132 and 136 and the nuts 44 and 46) and is also capable of disassembly for shipping, sale and storage.

Those skilled in the art will perceive advantages and modifications to these disclosed embodiments other than those specifically mentioned. For example, different sets of legs can be kept on hand to vary the height of the tool to perform different jobs, or feet may be included on the legs to provide additional stability.

Although specific embodiments of the invention have been described in detail herein with reference to the accompanying drawings, it is to be understood that the invention is not limited to those embodiments or to the changes or modifications specifically mentioned. Various other changes and modifications to the arrangements disclosed herein may be effected without departing from the spirit or scope of the invention as defined in the following claims.

What I claim is:

1. A tool support that can be provided as a kit and for supporting a tool having at least one handle, said tool support comprising:

clamping means for securely holding a handle of a tool, said clamping means including two clamping members for holding the tool handle therebetween, each said clamping member including engaging portions for cooperating with said engaging portions on the other said clamping member and an arcuate portion generally partially circular in cross-section, said engaging portions including flanges, having holes therein, extending in generally diametrically opposed directions from the ends of said arcuate portion;

leg means adapted to be attached to said clamping means for supporting the tool on a surface, said leg means including two leg members adapted to be attached to said cooperating engaging portions for urging said clamping members together with the tool handle therebetween, each of said leg members including a rod for extending through said holes in said flanges, each said rod having fastening means at an end thereof for urging said cooperating flanges together; and anti-twist means for rigidly securing said leg means to said clamping means to prevent relative rotation therebetween, said anti-twist means including tabs depending from the distal ends of said flanges on one of said clamping members, each said tab having a hole therein through which one end of one of said leg members extends, and an L-shaped offset portion at said one end of each said rod, the extreme of each said L-shaped offset portion extending through said holes in said cooperating flanges and the intermediate portion of each said L-shaped offset portion extending through one of said holes in said depending tabs.

2. A tool support as claimed in claim 1, wherein said fastening means includes a threaded portion at the end of each said rod and a nut accepted on said threaded portion.

3. A tool support for supporting a tool having at least one handle, said tool support comprising:

clamping means comprising two mating clamping members each of which is formed with a generally arcuate central portion, and two flanges extending in diametrically opposing directions from said central portion, said flanges of each said clamping member being formed to lie in confronting relation to said flanges of the other of said clamping members to cause said arcuate central portions together to define a clalmp adapted to embrace the handle of the tool, each pair of said confronting flanges having registered holes therein;

two leg members for supporting said clamping members on a surface, each said leg member including a rod having a first end formed to extend through the registered holes in one pair of said confronting flanges, and a second end depending from the first end to engage the surface and support said clamping means thereabove;

fastening means associated with said first end of each said rod for urging the flanges of one said pair of confronting flanges together thereby to urge said arcuate portions together about the handle of the tool; and anti-twist means for rigidly securing said leg members to said clamping means to prevent relative rotation therebetween, said anti-twist means including a tab depending from the distal end of each said flange on one of said clamping members, each said tab having a hole therein, said one end of each said leg member having an L-shaped offset portion, the extreme of each said L-shaped offset portion extending through said registered holes in said cooperating flanges and an intermediate portion of each said L-shaped portion extending through one of said holes in said depending tabs.

4. A tool support as claimed in claim 3, wherein said fastening means includes a threaded portion at said first end of each said rod and nuts accepted on said threaded portion on opposing sides of said confronting flanges.

* * * * *

UNITED STATES PATENT AND TRADEMARK OFFICE

CERTIFICATE OF CORRECTION

PATENT NO. : 4,747,213

DATED : May 31, 1988

INVENTOR(S) : LEONARD J. ARMSTRONG

It is certified that error appears in the above-identified patent and that said Letters Patent is hereby corrected as shown below:

AT [57] IN THE ABSTRACT

Line 1, "inclues" should read --includes--.

COLUMN 2

Line 7, "member" should read --member 12--.
Line 52, "member" should read --members--.

COLUMN 3

Line 41, "embodiment" should read --embodiments--.

COLUMN 4

Line 47, "clalmp" should read --clamp--.

UNITED STATES PATENT AND TRADEMARK OFFICE

CERTIFICATE OF CORRECTION

PATENT NO. : 4,747,213

DATED : May 31, 1988

INVENTOR(S) : LEONARD J. ARMSTRONG

It is certified that error appears in the above-identified patent and that said Letters Patent is hereby corrected as shown below:

COLUMN 5

Line 4, "L-shaped portion" should read --L-shaped offset portion--.

Signed and Sealed this

Twenty-seventh Day of December, 1988

*Attest:*

DONALD J. QUIGG

*Attesting Officer*

*Commissioner of Patents and Trademarks*